United States Patent [19]

Vossen

[11] 4,108,343

[45] Aug. 22, 1978

[54] METHOD OF AND APPARATUS FOR BREAKING AWAY OF PREPUNCHED PIECES OF MATERIAL FROM CURVED OR ARCHED SHEETS OF MATERIAL

[76] Inventor: Franz Vossen, Boisheimer Strasse 58, 4057 Bruggen 1, Fed. Rep. of Germany

[21] Appl. No.: 711,464

[22] Filed: Aug. 4, 1976

[30] Foreign Application Priority Data

Aug. 8, 1975 [DE] Fed. Rep. of Germany ..... 2535452

[51] Int. Cl.[2] ..... B26F 3/00

[52] U.S. Cl. ..... 225/1; 83/103; 93/36 A; 225/97

[58] Field of Search ..... 83/103; 93/36 A; 225/1, 225/2, 97, 96, 96.5, 93, 104

[56] References Cited

U.S. PATENT DOCUMENTS

| | | | |
|---|---|---|---|
| 2,759,402 | 8/1956 | Jedlick | 93/36 A X |
| 3,014,412 | 12/1961 | Barcia et al. | 225/97 |
| 3,055,275 | 9/1962 | Schroter | 93/36 A |
| 3,249,272 | 5/1966 | Scarpa | 93/36 A X |
| 3,335,927 | 8/1967 | Zweibel | 225/97 |
| 3,552,615 | 1/1971 | Murray | 225/97 |

*Primary Examiner*—Frank T. Yost

*Attorney, Agent, or Firm*—Lerner, David, Littenberg & Samuel

[57] ABSTRACT

In a method of and apparatus for breaking away of prepunched pieces from a curved or arched sheet of material, the sheet is applied to a block, and the pieces of material to be broken away are individually engaged between a pointed component acting on the upper surface of the sheet and a counter pressure mounting support acting on the lower surface of the sheet. Said pointed component on downward movement penetrates said upper surface only to the extent necessary to prevent relative lateral movement between the two, and said counterpressure mounting support supports oppositely disposed edge portions of the piece of material to be broken away, continuing downward movement of said pointed component causing said piece of material to bend under load to the extent that it loses its holds on said edge portions and is pushed through said mounting support to be released from said pointed component on leaving said mounting support.

27 Claims, 21 Drawing Figures

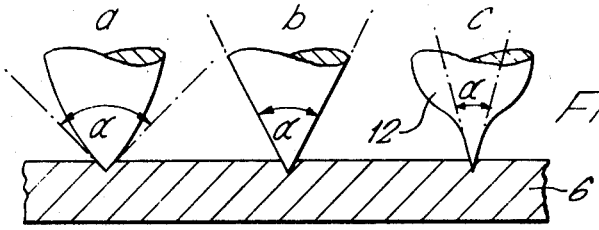
FIG. 5.
FIG. 6.
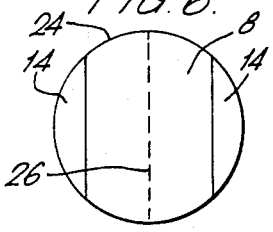
FIG. 7.
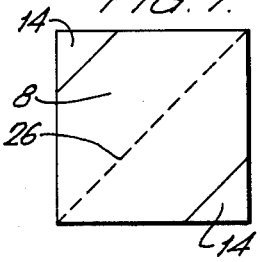
FIG. 8.
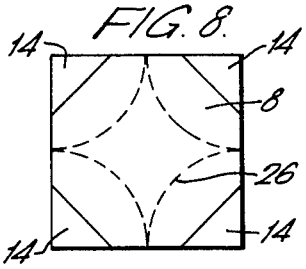
FIG. 9.
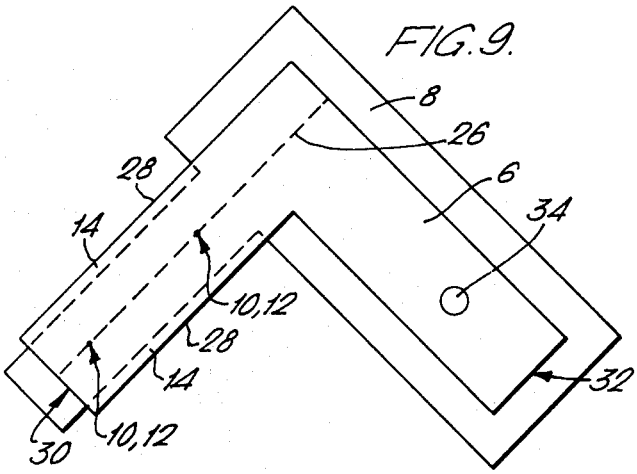
FIG. 10.
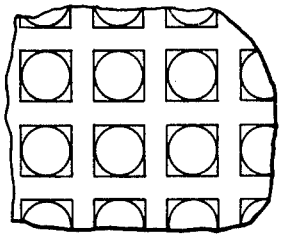
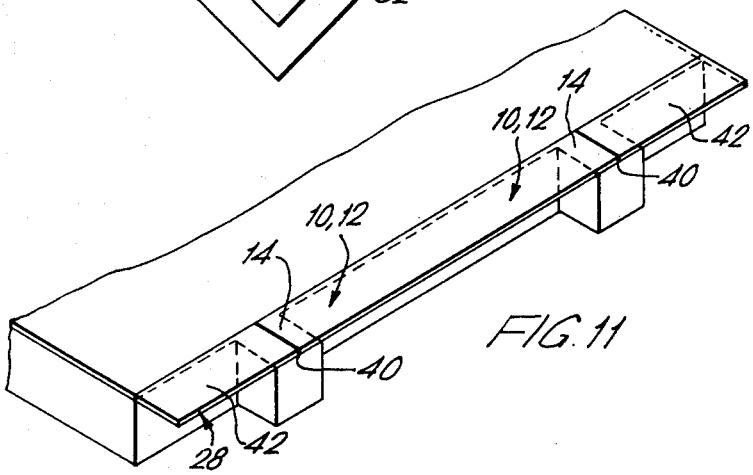
FIG. 11

FIG. 12.
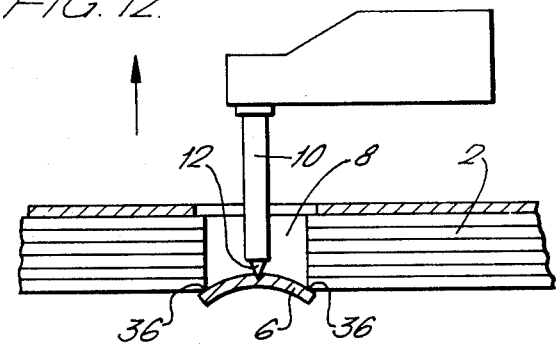
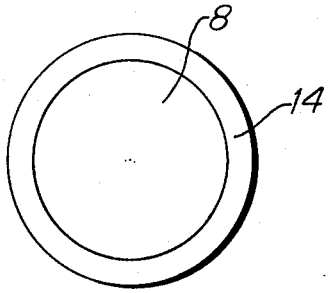
FIG. 15
FIG. 13.
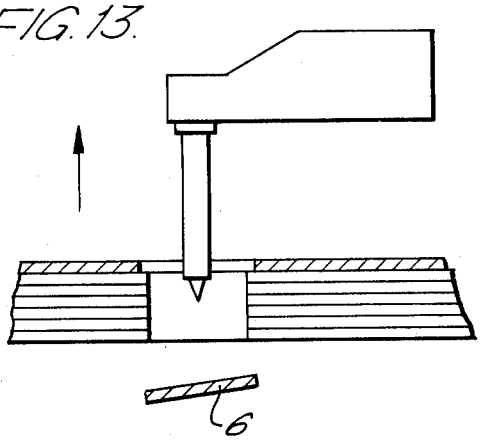
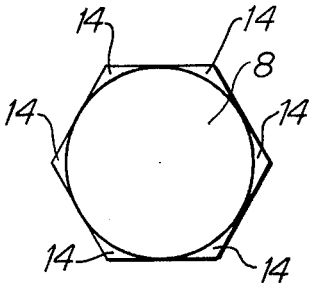
FIG. 16
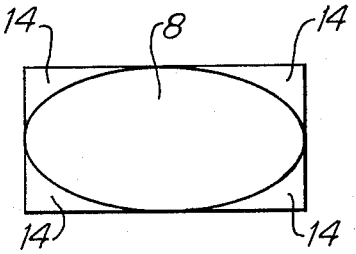
FIG.17
FIG. 14.
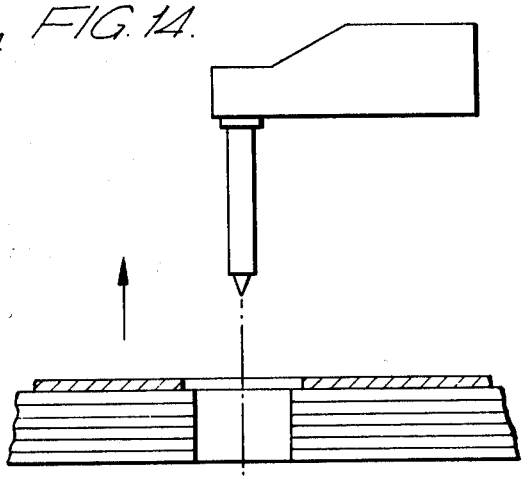
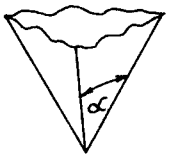
FIG. 18

METHOD OF AND APPARATUS FOR BREAKING AWAY OF PREPUNCHED PIECES OF MATERIAL FROM CURVED OR ARCHED SHEETS OF MATERIAL

The invention relates to a method of breaking away prepunched pieces of material from curved or arched sheets of material, in which the sheet of material is applied to a break-away block, the material pieces to be broken away are engaged on one side by a pointed component and on the other side by a counter pressure mounting support and are broken away from the sheet of material, as well as an apparatus for carrying out the method.

A method of this kind is known from Federal German Specification No. 1,511,077 as published after acceptance. The pointed component used in accordance with this specification is a spike with barbs, which pierces the piece of material to be broken away in a first direction directed on to the counter pressure mounting support and into the latter and engages the piece of material by means of the barbs in a second opposed movement and breaks it out of the sheet of material. As the movement continues the spike passes through a stripping plate which strips off the impaled piece of material from the spike and lets it slip into a scrap receptacle.

The use of spikes with barbs to impale the piece of material to be broken away from a sheet of material has also become known from further printed specifications, see for example the U.S. Patent Specifications Nos. 3,320,864 and 3,371,584. In the punching machine disclosed the spikes are arranged within a drum and/are first of all moved out of the drum through suitable guides, in order to impale the waste piece and to be again freed from the waste piece by means of a stripper moving outwards, the waste piece thereupon dropping downwardly through gravity (see the U.S. Patent Specification No. 3,371,584). U.S. Patent Specification No. 3,320,864 works in a similar manner, the stripping effect being achieved either by the impaling spike being withdrawn into a stripping housing or simply by the sheet of material running on in a straight line while the spike with the impaled waste piece turns away downwardly on the drum.

Federal German Patent Specification No. 1,191,217 also makes use of the first possibility which primarily uses a spike without undercut impaling the waste pieces.

Another possibility for stripping impaled paper scraps is shown in U.S. Patent Specification No. 2,711,676. The spikes mounted on a drum go to a comb-like structure through the teeth of which the spikes travel and thus strip off the remainder of the paper. The apparatus according to German Patent Specification No. 1,017,456 works in a similar manner, the impaler in this case having several spikes.

All of the apparatuses disclosed have serious disadvantages. The comb-like stripper used with the rotating punch presses very seriously restricts the shaping possibilities for the punching tool. Either the comb-like stripper must be appropriately altered when the desired cut-outs are altered, or the cut outs can be arranged only in accordance with the arrangement of the comb teeth. Besides it is difficult to get a secure stripping effect by means of the comb in the case of complex punching shapes.

In German Patent Specification No. 1,191,217 it is disadvantageous that also in this case only quite definite shapes can be included for the pieces of material to be broken away, so that the machine must be re-designed when there is a change in the desired initial material and prohibitive costs are involved in this re-designing.

The same goes for the punching presses of U.S. Patent Specifications Nos. 3,371,584 and 3,320,864.

The method described in German Patent Specification No. 1,511,077 as published after acceptance and initially mentioned herein is also disadvantageous. Because of the fact that the piece of material to be broken away is fully pierced by the spike, it is necessary to provide a special stripper which again stips off the waste piece from the barbs formed by the undercutting of the spike after the breaking away. This requires a relatively expensive mechanism which can be changed over only in a complicated manner moreover with changes in sectional shape.

Another way of solving the problem is taken by Federal German Patent Specification No. 1,149,976 and also Federal German Patent Specification No. 2,158,907. According to these patent specifications the piece of material to be broken away is engaged on both sides by spikes and broken away from the sheet of material and removed. This break-away method works extremely satisfactorily. However, the expenditure is really high and there are also difficulties if several parts to be broken away are disposed very close together. In this event the springing back locking spikes arranged on one side are obstructed as they occupy a relatively large amount of space. If a large number of closely disposed pieces of material are to be broken away from a sheet of material the process disclosed in these patent specifications cannot therefore be used. A further disadvantage resides in the fact that when the pieces of material to be broken away are very small these remain on the upper side of the lower break-away stud and can lead to breakdowns. In such cases therefore additional devices are to be provided in order to prevent that.

The problem of the invention is to provide a method of breaking away prepunched pieces of material of the initially mentioned kind, in which the shape and position of pieces of material to be stamped out are arbitrarily selectable and in which no particular precautionary measures must be taken in order to remove the broken away piece of material from the pointed component. Moreover, the method should enable a very quick and simple changing of the desired distribution and shape of the pieces of material to be broken away.

According to the invention this problem is solved in that the spikes of the pointed component penetrate into the surface of the piece of material to be broken away only to an extent sufficient to prevent lateral displacement of the spike in relation to the surface, that the counter-pressure mounting support supports substantially opposed parts of the edge of the piece of material to be broken away until through the proper movement of the pointed component in the direction of the counter-pressure mounting support the piece of material deflects to such an extent that it loses its hold on the edge portions, that the piece of material in the bent condition is pushed through the counter-pressure mounting support and after leaving the latter is released from the pointed component.

Because of the fact that the pointed component penetrates into the surface of the piece of material to be broken away only to an extent sufficient to prevent lateral displacement of the spike in relation to the surface, that therefore the spike does not impale the strips of material through deep penetration or even penetrate the latter, there is no need to provide a stripping procedure in the method. The spikes have only to serve the purpose of increasing the friction between the spike and the piece of material to be broken away to the extent that the spike does not slide off the piece of material on movement through the counter-pressure mounting support, so that the piece of material as far as possible remains attached at one side of the sheet of material and thus the spike slides past the piece of material without separating same fully from the sheet of material.

On being forced through the counter-pressure mounting support the piece of material is bent resiliently. When it reaches the end of the counter-pressure mounting support its edges are released and the hitherto bent piece of material springs back whereby it receives a component of movement which is directed away from the spike. This dynamic force may be so strong that the piece of material flies away from the spike at high speed. This represents a particularly advantageous development of the method according to the invention.

If the spike moves very quickly the kinetic energy impressed on the piece of material by this quick movement is already sufficient to throw it away from the spike after the penetration of the counter-pressure mounting support. This also represents an advantageous development of the method according to the invention.

In accordance with a further development of the invention the piece of material is separated from the pointed component merely through its gravitational force.

When the material is very thin it can sometimes happen that the spike penetrates so far into the material and also the spring force is not sufficient in order after the passage through the counter-pressure mounting support to separate from the spike solely on the basis of the gravitational force or dynamic forces.

In accordance with a further advantageous embodiment the piece of material on withdrawal of the pointed component is then separated from the pointed component by the back edge of the counter-pressure mounting support.

The form of the counter-pressure mounting support depends very much on the material of the curve or arch to be punched and also on the position and shape of the piece of material to be broken away.

When the pieces of material to be broken away are substantially round it is desirable in accordance with a further embodiment of the invention to support the material through two mutually opposed edge strips. When the piece of material to be broken away is square the corners of this piece should be supported. In both cases there is a line of bend extending through the middle of the piece of material.

The bending is more complicated if in accordance with a further embodiment there is to be supports at all four corners in the case of a square piece of material.

When the pieces of material to be broken away are very complex but have a lamellar part it is advantageous to support edge portions of this part. Further parts extending/far outwardly from this part may be engaged by means of break-away studs from both sides in accordance with a further embodiment of the method, as is taught in German Patent Specification No. 2,158,907.

If there are to be separated long edge pieces which are connected with the remainder through necks it is desirable in accordance with a further method of the invention to sub-divide the edge piece at least twice and to provide support shoulders at these sub-divisions. The edge piece is then bent between the two support shoulders and separated out.

The method according to the invention can be used to particular advantage if a large number of closely adjacent openings are to be made in a sheet of material as no further tools are necessary beyond the break-away spikes and the mounting support. If the closely adjacent openings are square or rectangular the shape of the mounting support is circular or elliptical.

This method is particularly suitable also for material of low strength such for example as typewriter paper or wrapping paper.

Further advantages and details of the invention follow from the following description in conjunction with the accompanying drawings, wherein:

FIGS. 5 and 18 show different forms of spike in cross-section;

FIGS. 6 to 10 and 15–17 show different kinds of the arrangement of support surfaces for various geometric shapes of the piece of material to be broken away;

FIG. 11 shows an apparatus for breaking end pieces out of the sheet of material;

FIGS. 12 to 14 show the apparatus of FIG. 1 for the case where the spike has penetrated too far into the piece of material to be broken away and the counter-pressure mounting support is used for stripping off the piece of material.

Figure 1:
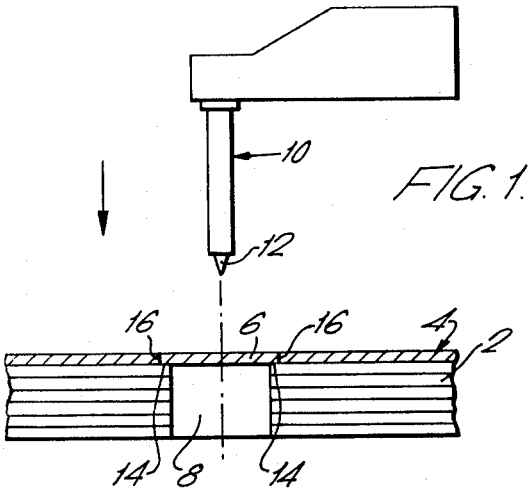
FIG. 1 shows schematically a cross-section through an apparatus for carrying out the method according to the invention, namely in the stage before breaking away is started.

There is shown schematically in FIG. 1 an apparatus by means of which the method according to the invention can be carried out. The apparatus comprises a counter-pressure mounting support 2 on which a curved or arched sheet 4 of material is disposed. A piece 6 is punched out of the curved sheet of material but is still attached by small bridges of material (such a bridge of material is also known as a "neck") with the remainder of the sheet 4 of material, so that the punched-out piece of material can not of itself fall out of the sheet of material. Below the prepunched piece of material there is provided within the counter-pressure mounting support a borehole 8 the cross-section of which is less at least a few points than that of the piece 6 of material to be broken away. Above the piece of material is a pointed component which is here shown as a break-away stud 10 and may be secured, for example, by means of a clamping device to an upper tool of a break-away appliance (not shown) belonging to a punch press. Through this clamping arrangement it is possible to arrange break-away spikes at any desired position about the sheet 4 of material. The break-away stud has a spike 12 the exact form of which will hereinafter be explained in more detail.

Figure 2:
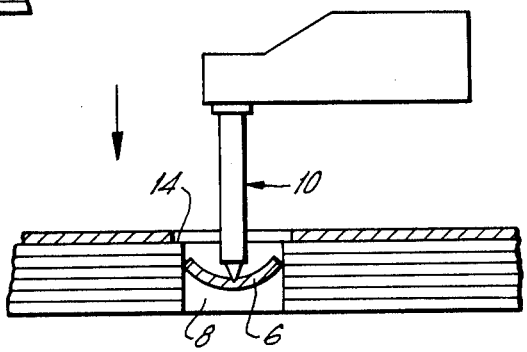
FIG. 2 shows the apparatus of FIG. 1 during the breakingaway procedure.
Figure 3:
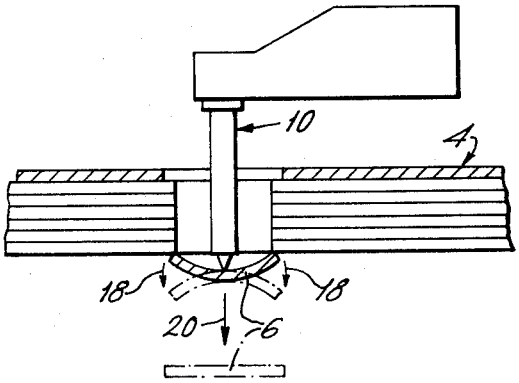
FIG. 3 shows the apparatus of FIG. 1 during the throwing-off of the broken-away part.

Because of the fact that the borehole or opening in the counter-pressure mounting component 2 has, in the sectional plane shown, a diameter somewhat smaller than the piece 6 of material to be broken away, the piece 6 of material to be broken away is supported at its lateral edges 16 on corresponding shoulders 14 which are formed by the counter-pressure mounting support. This leads to the piece 6 of material to be broken away first of all bending, on the break-away stud moving down (see FIG. 2), before it loses its hold on the shoulder 14 of the counter-pressure mounting support and being pushed in bent or bowed form by the break-away stud through the opening 8. Along with the bending and subsequent pushing of the piece of material through the counter-pressure mounting support the necks, that is the connecting bridges between the sheet of material and the piece of material, are broken.

With further progressive downward movement of the break-away stud 10 to the top edges of the piece 6 of material to be broken away finally reach the lower edge of the opening 6 in the counter-pressure mounting support. As soon as the piece 6 of material gets free, the lateral compression, which had kept the piece of material tensioned like a spring, vanishes. This resilience, which may be greater or lesser depending on material and degree of bending, leads to the piece of material moving at its ends in the directions of arrows 18 after getting free, while the middle part is held by the spike 12 of the break-away pin continuing its downward movement. The whole mass of the piece 6 of material thereby receives a component of motion which is directed away from the spike of the break-away stud 10, see arrow 20.

In order that the break-away procedure proves to be successful even in the form represented up to now, it is necessary that the spike 12 of the break-away stud 10 does not slip on the piece 6 of material when the spike pushes through the plane of the sheet 4 of material. If slippage occurs, it can lead (see FIG. 4)to the piece 6 of material to be broken away remaining connected at one side through one or more necks 22 with the sheet 4 of material and not be broken away, but only bent outwards. This can lead to serious disorders in the subsequent manufacturing operations.

Figure 4:
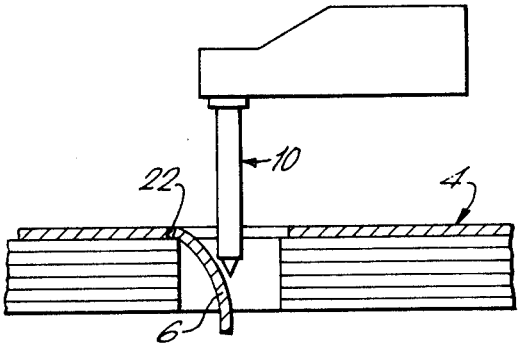
FIG. 4 shows the apparatus of FIG. 1 in the event of trouble due to too little friction between the spike and the part to be broken away.
Figure 21:
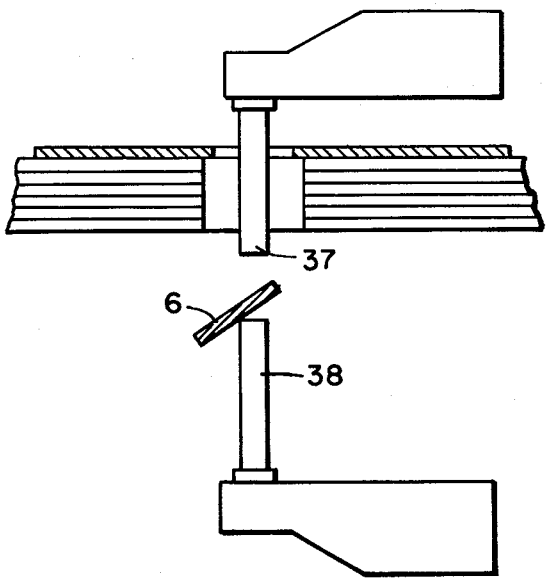
Figure 20:
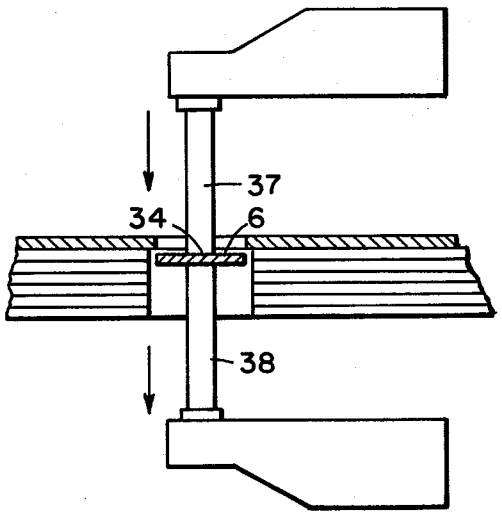
FIGS. 19 to 20 show schematically the additional clamping tool for gripping the piece of material in accordance with the arrangement of FIG. 9.
Figure 19:
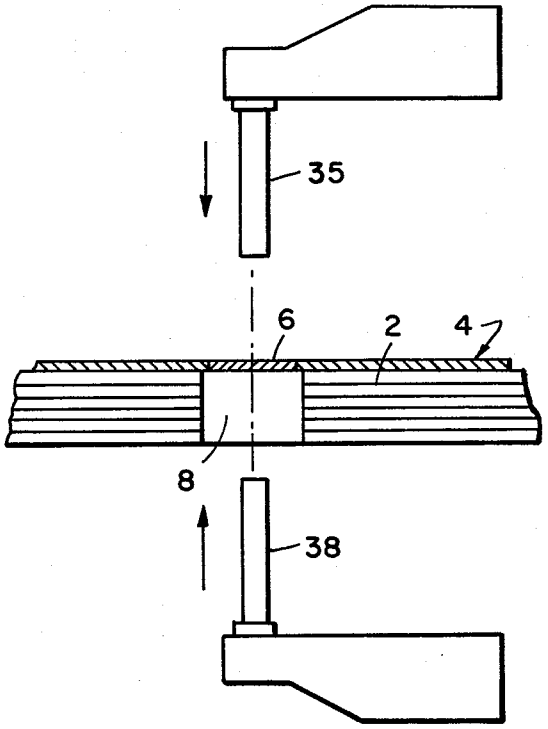

In order that the case represented in FIG. 4 does not arise, it is necessary for the spike 12 of the break-away stud 10 to penetrate into the piece 6 of material to such an extent that, even when lateral forces crop up, displacement of the spike 12 relative to the piece 6 of material is not possible. Various cross-sections of spike are possible according to FIG. 5. In addition to a plain conic apex with straight edge lines (FIG. 5*b*), the spike may also beof convex (FIG. 5*a*), or concave (FIG. 5*c*) form. The concave form (FIG. 5*c*), commonly called a frog point, has proved to be particularly advantageous, as this form of spike, as opposed to the other two forms, ensures that the spike penetrates only to such an extent that there is sufficient security against lateral displacement. On the other hand too deep a penetration is prevented, and this makes easier the subsequent removal of the piece of material from the spike. The spike may comprise a circular cone or even a polygonal pyramid, as shown in FIG. 18.

In FIG. 6 there is shown how the counter-pressure mounting support may be constructed when the piece of material to be broken away is circular with a circumference 24. The support comprises, according to FIG. 6, the opening 8 and the bearing or contact surfaces 14 which consequently form segments of the circle formed by the circumference 24. If the bearing or contact surfaces 14 are arranged opposite one another, the piece to be broken away is bent along the line of bend 26 while being pushed through the counter-pressure mounting support of FIG. 2.

When the pieces of material to be broken away are oval, the line of bend should coincide with the axis of the ellipse.

Where the material involved is of low strength and the portion to be cut out is substantially circular in shape, the hold-back means should be circular with a somewhat lesser diameter than the circle of the piece of material to be broken away, as shown in FIG. 15.

Where the material involved is of low strength and the portion to be cut out is polygonal in shape, the hold-back means should be circular with a somewhat lesser diameter than the circle circumscribing the polygon, as shown in FIG. 16.

Where the portion to be cut out is rectangular, the hold-back means should be in the shape of an ellipse with axial lengths corresponding to the edge lengths of the rectangle, as shown in FIG. 17.

When the pieces of material to be broken away are rectangular, especially square (see FIG. 7), it has proved to be particularly advantageous to place the bearing or contact surfaces at two opposite corners. The line of bend then extends along a diagonal of the rectangle. If the rectangle is fairly elongate, it is more advantageous to locate the bearing or contact surfaces parallel to two mutually-parallel side edges. It is generally more advantageous to select for this purpose the smaller side edges. Complicated bending forms result when in the case of a square all four corners receive bearing or contact surfaces 14 (see FIG. 8).

Which arrangement of bearing or contact surfaces is especially advantageous at any time depends very much on the strength and construction of the sheet of material. The bearing or contact surfaces must if possible be so selected that on pushing the piece of material through the counter-pressure mounting support in accordance with FIG. 2, there should be available sufficient (potential) resilient force to be used, after conversion into kinetic energy when the piece of material is released from the counter-pressure mounting support, to project the piece of material away from the spike 12 of the break-away stud 10.

The method in accordance with the invention also enables the breaking away of more complex shapes than those shown in FIGS. 6 to 8. For example, FIG. 9 shows an angle shape very difficult to deal with in the break-away art. With this shape it suffices to arrange the bearing or contact surfaces 14 at two mutually-opposed possibly parallel cut edges 28 of one limb 30 of the angle shape. The remaining cut edges and especially the other limb 32 of the shape, on the contrary, are not supported, but can be disposed even completely freely within the opening 8, the cross-section of the opening 8 being made larger at these positions than would correspond to the cross-section of the shape to be broken away.

On downward movement of a break-away stud 10, or preferably in the case of long pieces of a plurality of break-away studs 10, the shaped piece is bent by the counter-pressure of the support or contact surfaces 14 along the line of bend 26 and pushed to the bottom through the opening 8. On leaving the counter-pressure mounting support the piece is separated from the break-away stud or studs 10, 12 in the manner hereinbefore described.

When complex shaped pieces of this nature are involved, sufficient acceleration away from the break-away spike of integrally-attached parts, such as the limb 32 in the angle shape shown in FIG. 9, can not always be guaranteed. It is thus desirable to grip these attached parts by an additional device which, referring to FIGS. 9 and 19-21, consists of an upper and a lower tool 37, 38 which clamps the piece of material from above and below at a precise position, e.g. 34, and in synchronous movement with the break-away studs 10 directs the piece of material to the bottom and there releases same. This additional gripping position should be so located to one side that the piece of material on being released by the clamping tools 37, 38 drops out of the clamping tools through its own gravitational force or through the kinetic energy impressed in conformity with the procedure. An appropriately formed clamping tool is described in Federal German Patent Specification No. 2158907 as published after acceptance.

The method in accordance with the invention is particularly suitable for workpieces which have parts to be broken away which are located very close to one another and also very small. For example, there is shown in FIG. 10 a cutaway portion of a sheet of material in which numerous square openings are to be produced to be disposed very closely side by side. Punched or stamped parts of this nature could be broken away only with difficulty with the method hitherto known, as the individual break-away tools obstructed one another. With the method according to the invention, in which merely the relatively thin studs together with their mounting are necessary, even very closely adjacent and very small parts to be broken away can be removed. In the example shown the bearing or contact surface is circular in form, so that the square pieces of material to be broken away are supported at the four corners. A complex bending pattern is therefore formed, as is shown also in FIG. 8, for example.

The embodiment of FIG. 10 has given satisfactory results particularly in the case of sheets of paper-like material, as in this case the risk is particularly great that the pieces to be broken away continue to adhere. Through the circular opening the piece to be broken away is, as it were, placed around the break-away stud and in this way definitely separated from the remainder of the sheet of material.

If, however, the kinetic energy of the piece of material to be broken away, or its gravitational force, is just not sufficient to separate it from the spike 12 of the break-away stud 10, the piece 6 of material is stripped off from the spike 12 by means of the lower edge 36 of the opening in the counter-pressure mounting support when the break-away stud goes back (see FIG. 12). The piece 6 of material then drops downwardly through its own gravitational force, while the break-away stud returns to its initial position, in order that the sheet of material freed from the pieces of material to be broken away can be removed and a new sheet of material for the next breaking-away operation can be introduced (FIG. 14).

FIG. 11 shows another embodiment of the apparatus according to the invention, which serves particularly for the breaking-away of end pieces from sheets of material. Pieces of material to be broken away at the edge of the sheet of material may likewise be dealt with in accordance with the method according to the invention. For that purpose it is necessary to provide the end edge 38 with notches 40 and to arrange bearing or contact surfaces 14 at these notches. By means of one or even two break-away studs 10, 12 it is then possible to separate the piece of material to be broken away and located between the notches (see FIG. 11). It may be desirable with longer edges to provide further separating or disconnecting points. In the example shown in FIG. 11, the edge portions 42 both to the left and the right of the two separating points are not separated. If these portions are also to be removed, yet another bearing or contact surface and also a corresponding further break-away stud must be provided at each of the ends.

I claim:

1. A method of breaking pre-punched pieces of material away from flexible sheets of material, comprising the steps of applying the sheet of material to a break-away block, engaging the pieces of material to be broken away, on one side by a pointed component which penetrates into the surface of the piece of material to be broken away only to such an extent as to prevent lateral displacement of the spike in relation to the surface, and on the other side by a counter-pressure mounting support which supports substantially oppositely-disposed portions of the edge of the piece of material to be broken away, moving the pointed component further in the direction of the counter-pressure mounting support whereby the piece of material bows under load to such an extent that it loses its hold on said oppositely disposed edge portions, and pushing the piece of material in the bowed condition through the counter-pressure mounting support whereby it is released from the pointed component after leaving said mounting support.

2. A method as set forth in claim 1, comprising separating the piece of material from the pointed component through the kinetic energy which it receives through the pointed component.

3. A method as set forth in claim 1, in which the pieces of material on leaving the counter-pressure mounting support springs back again into its flat shape and thus produces a dynamic force, which detaches it from the pointed component.

4. A method as set forth in claim 1, in which the piece of material is separated by its gravitational force from the pointed component.

5. A method as set forth in claim 1, in which the piece of material is separated from the pointed component by the rear edge of the counter-pressure mounting support on the return movement of the pointed component.

6. A method as set forth in claim 1, im which in the case of a substantially round piece of material, the counter-pressure mounting support supports two oppositely-disposed edge strips of the piece of material.

7. A method as set forth in claim 1, in which in the case of a substantially rectangular piece of material, the counter-pressure mounting support supports two oppositely-disposed corners of the rectangular piece of material.

8. A method as set forth in claim 1, in which in the case of a substantially rectangular piece of material, the counter-pressure mounting support supports the piece of material at each corner.

9. A method as set forth in claim 1, in which in the case of a complex-shaped piece of material having a lamellar portion, two oppositely-disposed edge strips are provided on the latter and are supported by the counter-pressure mounting support.

10. A method as set forth in claim 9, in which an extensively projecting part of the piece of material to be broken away is taken along by a clamping device moving synchronously with the pointed component.

11. A method as set forth in claim 1, in which where a long edge is involved, this is sub-divided at least twice and support shoulders are arranged at two mutually-opposite divisions.

12. A method as set forth in claim 1, in which where the material involved is of low strength and is substantially circular in shape, the hold-back means is circular with a somewhat lesser diameter than the circle of the piece of material to be broken away.

13. A method as set forth in claim 1, in which, where the material involved is of low strength and is polygonal in shape, the hold-back means is circular with a somewhat lesser diameter than the circle circumscribing the polygon.

14. A method as set forth in claim 13, in which the piece to be broken away is rectangular and the mounting support is an ellipse with axial lengths corresponding to the edge lengths of the rectangle.

15. Apparatus for breaking pre-punched pieces of material away from curved or arched sheets of material, wherein a sheet of material moves along a guidance plane, said apparatus comprising a break-away spike above said guidance plane, means for moving said spike downwardly through said guidance plane, a counter-pressure mounting support normal to said break-away spike on the other side of said guidance plane, said counter-pressure mounting support being formed by edge portions of an opening, said edge portions extending into the area of cut of a piece of material to be broken away, the cross-section of said opening except for the inwardly extending edge portions corresponding at least to the area of cut of said piece of material, said opening being cut into a guide plate forming said guidance plane.

16. Apparatus as set forth in claim 15, wherein said opening has a cross-section remaining constant in the direction of movement of said break-away spike, which cross-section with the exception of said edge portions projecting into said area of cut is greater than said area of cut defining the shape of said piece of material to be broken away.

17. Apparatus as set forth in claim 16, wherein said break-away spike represents at its point a cone with such a conic angle that said spike penetrates only slightly into the material at the surface of said piece of material to be broken away to prevent lateral sliding movement without penetrating said piece of material to be broken away.

18. Apparatus as set forth in claim 17, wherein said spike has in axial section the shape of a frog point.

19. Apparatus as set forth in claim 17, wherein said spike has in axial section the shape of two circular sectors laid against one another.

20. Apparatus as set forth in claim 17, wherein said spike has the form of a pyramid of at least three sides.

21. Apparatus as set forth in claim 15, including a plurality of break-away spikes.

22. Apparatus as set forth in claim 15, including in addition to said break-away spike, other break-away studs engaging said piece of material to be broken away both from above and from below, and drawing same downwardly after the engagement.

23. Apparatus as set forth in claim 15, wherein, when substantially circular areas of cut are involved, said edge portions projecting into such an area of cut are two oppositely-disposed circular segments.

24. Apparatus as set forth in claim 15, wherein, when said areas of cut are substantially rectangular, said edge portions projecting into such an area of cut are two corners of the rectangle.

25. Apparatus as set forth in claim 15, wherein, where said areas of cut are substantially square, said edge portions projecting into such an area of cut are the four corners of the square.

26. Apparatus as set forth in claim 15, wherein, when said piece of material has a complex shape and has a strip-like part, two mutually-opposite edge strips project into the area of cut at said part.

27. Apparatus as set forth in claim 15, wherein, in the case of edge pieces, at least two sub-divisions of each edge piece are provided with support edges.

* * * * *